United States Patent [19]

Thompson et al.

[11] 4,239,288

[45] Dec. 16, 1980

[54] SOLUTION MINING METHOD UTILIZING SUB-SURFACE AQUIFER

[75] Inventors: Robert E. Thompson, Moose Jaw; Henry A. Antemuik, Regina, both of Canada

[73] Assignee: PPG Industries Canada, Ltd., Regina, Canada

[21] Appl. No.: 8,449

[22] Filed: Feb. 1, 1979

[51] Int. Cl.[2] ..... E21B 43/28

[52] U.S. Cl. ..... 299/5; 299/4

[58] Field of Search ..... 299/4, 5, 17; 166/269, 166/305 D, 314; 175/213; 417/54, 197, 198

[56] References Cited

U.S. PATENT DOCUMENTS

| | | | |
|---|---|---|---|
| 134,397 | 12/1872 | Reed | 417/197 |
| 3,262,741 | 7/1966 | Edmonds et al. | 299/4 |
| 3,448,691 | 7/1967 | Frazier | 417/197 |
| 3,556,597 | 2/1969 | Porter | 299/5 |
| 3,652,129 | 3/1972 | Edmonds | 299/4 |
| 3,957,306 | 5/1976 | Closmann | 299/4 |

*Primary Examiner*—Ernest R. Purser

*Attorney, Agent, or Firm*—Irwin M. Stein; Walter M. Benjamin

[57] ABSTRACT

Disclosed is an improved method of solution mining a mineral from a subterranean deposit thereof, where an aqueous solvent is introduced into the deposit and a solution enriched in the mineral is withdrawn from the deposit through a conduit which traverses a water bearing formation which overlies the deposit. The improvement comprises establishing through the wall of the conduit communication between the water bearing formation and the conduit to effect dilution of the enriched withdrawn solution thereby avoiding plugging of the conduit caused by crystallization of the mineral.

10 Claims, 3 Drawing Figures

SOLUTION MINING METHOD UTILIZING SUB-SURFACE AQUIFER

BACKGROUND OF THE INVENTION

This invention relates to a method of solution mining a soluble mineral from a subterranean deposit therof having an overlying water bearing formation. More particularly, this invention relates to the method of utilizing water from the water bearing formation to prevent plugging of a withdrawal conduit caused by precipitation of the mineral from the solution being withdrawn.

Subterranean deposits of soluble minerals of various descriptions can be recovered by solution mining. In a typical solution mining operation a salt is recovered from a deposit thereof by introducing through a conduit in a bore hole in communication with the deposit an aqueous solvent for the salt. A solution of the desired salts is formed as a cavity is created by the extraction of salt from the deposit and an enriched solution is withdrawn from the deposit through the same or a second bore hole. The withdrawn solution can be treated for the production of the desired salt from the solution. This technique has been used to recover salts such as sodium chloride and potassium chloride from such mineral deposits as kalinite, sylvinite, carnallite, and like salts using solvents such as water and solutions unsaturated with respect to the desired salts.

Solution mining is typically employed when the mineral deposit is at substantial depths below the surface of the earth, i.e., greater than about 100 meters below the surface of the earth. These deposits may be found in New Mexico, Utah, Northern United States, and Canada and are most frequently between about 100 meters and and about 1800 meters below the surface of the earth. Deposits of these aforementioned salts and other minerals are found in many other parts of the world as well.

During the solution mining of these minerals deposits, cavities having substantial dimensions are created. Consequently, even at high flow rates through the cavity, the solvent becomes saturated with respect to the mineral. But, as the solution is withdrawn from the cavity the mineral precipitates owing to a decreasing solution temperature or owing to other factors. Such precipitation can cause plugging of the withdrawal conduit such that the solution can no longer be withdrawn from the cavity, thus requiring a shutdown and reworking to remove the blockage before the solution mining operation can be resumed.

Known methods of reducing or avoiding plugging the withdrawal conduit include introducing a smaller conduit concentrically within the withdrawal conduit such that enough diluting liquid can be mixed with the solution being withdrawn such that no solubility is exceeded within the withdrawal conduit. Alternately, other substances such as steam can be introduced into the conduit in order to increase the solubility of the mineral as the solution is withdrawn from the cavity.

Often these mineral deposits are overburded with water bearing formations or aquifers. Cavities in these deposits are solution mined in such a manner to avoid communication with the aquifers since this situation reduces the ability to pump fluid through the cavity. Further, the cavity solution is subject to contamination by minerals that often occur in these aquifers. When communication with the aquifer does occur, the practice is to minimize contamination of the cavity solution with a substantial amount of undesirable minerals by controlling the injection of solvent and withdrawal of solutions. Especially where the solvent is of a specifically designed composition to provide a selective extraction of specific minerals from the deposit, this contamination is particularly undesirable. Further, should uncontrollable amounts of water enter a cavity from the aquifer, undue dilution of product solution can occur rendering it impossible to economically recover the desired product.

SUMMARY OF THE INVENTION

It has been found that this water-bearing formation or aquifer can be utilized to avoid plugging of the withdrawal conduit by diluting the enriched solution withdrawn from the cavity. On the wall of the withdrawal conduit which traverses an overlying water-bearing formation, communication is made between the aquifer and the conduit to allow mixing of water from the aquifer to dilute the solution being withdrawn to avoid plugging of the withdrawal conduit caused by precipitation of the mineral dissolved in the enriched solution.

This can be accomplished in many ways. The flow of the solution through the withdrawal conduit can be restricted thereby causing a pressure drop which induces flow of water from the aquifer into the withdrawal conduit through a hole located in the wall of the conduit downstream from the restriction.

In cases where a pump has been inserted into the withdrawal conduit to pump solution from the cavity while regulating solvent introduced into the cavity to minimize the flow of water from the aquifer into the cavity, holes in the walls of the conduit at a location where the conduit traverses the aquifer induces water to flow into the withdrawal conduit. This phenomenon occurs because a solution density gradient exists in the cavity solution, i.e., low density brine is at the top and higher density brine at the bottom. Since the conduit is filled with high density brine during flowing conditions, a pressure differential is established across the hole in the conduit. The pressure is higher outside the pipe, so water must flow through the hole into the conduit where it mixes with the solution being withdrawn.

This system has the benefit of eliminating the necessity of running a small conduit for introducing water or some other substance down hole to provide dilution or otherwise increase the solubility of the mineral. The amount of diluting water from the aquifer can be metered such that only enough is introduced to avoid plugging of the withdrawal conduit. In cases where the aquifer contains a small amount of contaminating minerals the present invention can be used so long as the small amount of water needed for dilution of the solution being withdrawn is not enough to cause the contamination to be significant.

This invention is particularly useful during the solution mining of sylvinite (a mixture of potassium chloride and sodium chloride). Since the invariant composition (the composition at saturation with respect to two or more salts at a given solution temperature) of a sylvinite solution decreases with decreasing solution temperatures, one or both of the salts precipitate as a cooling saturated solution is withdrawn. Often, the solution is saturated only with respect to sodium chloride which precipitates upon cooling. These precipitating salts can accumulate to form a high density slurry or scale to restrict flow or eventually plug the withdrawal conduit. These undesirable conditions are usually avoided by diluting the withdrawn solution to less than about 97% saturation at bottom hole conditions in accordance with the present invention when the down hole temperature is about 60° C. and the depth about 1500 meters.

DETAILED DESCRIPTION OF THE INVENTION

Figure 1:
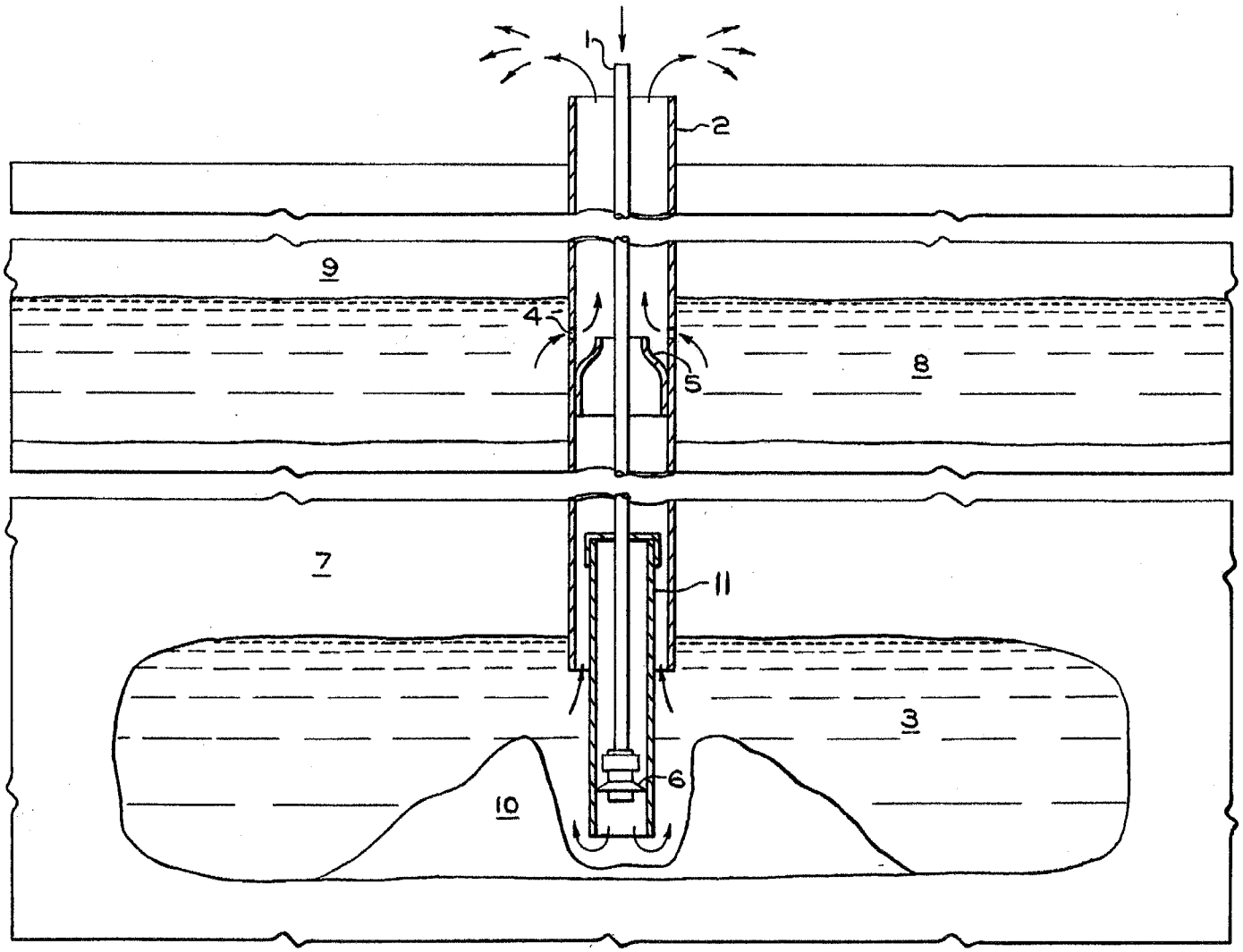
FIG. 1 diagrammatically illustrates a subterranean cavity in a mineral deposit being mined through one bore hole in communication therewith and having an overlying aquifer.

In accordance with the present invention an improved method of solution mining a soluble mineral from a subterranean cavity is presented where water from a overlying aquifer is utilized to affect dilution of the enriched saturated solution being withdrawn thereby avoiding plugging of the withdrawal conduit caused by precipitation of the dissolved mineral. Reference is now made to FIG. 1 which diagrammatically illustrates a cavity 3 in which the roof has collapsed and disposed a pile 10 of rubblized mineral 7 on the floor of the cavity. Soluble mineral 7 is overburdened by formation 9 containing aquifer 8. The cavity 3 is shown as being mined by concentric conduits 1, 2 and 11 disposed in one bore hole communicating with the cavity with an apparatus such as that which is disclosed by U.S. Pat. No. 3,556,597 or similarly it can be accomplished by using an apparatus which is disclosed by U.S. Pat. No. 3,391,962. Accordingly, in FIG. 1 it can be seen that the invention can be practiced by introducing a solvent into tubing 1 down through liner 11 which is hung on the tubing 1 and sealed by packer 6. The solvent contacts the rubblized ore thereby dissolving minerals from the ore. The enriched solution is withdrawn through casing 2 wherein restriction 5 is concentrically disposed. Restriction 5 creates a pressure differential in the solution being withdrawn before and after the restriction such that water from aquifer 8 is induced through hole 4 into casing 2, thereby diluting the solution being withdrawn. This effect can be enhanced by reducing the head above hole 4, such as by a pumping means on the surface. This action works on the same principle as injectors which are used for in-line mixing. The withdrawn solution being enriched and saturated with respect to the dissolved mineral does not precipitate the dissolved mineral because of the diluting effect of the water from aquifer 8. Hence, the solution can be withdrawn through casing 2 with essentially no problem of plugging caused by precipitated minerals in spite of the cooling of the solution during withdrawal.

Figure 2:
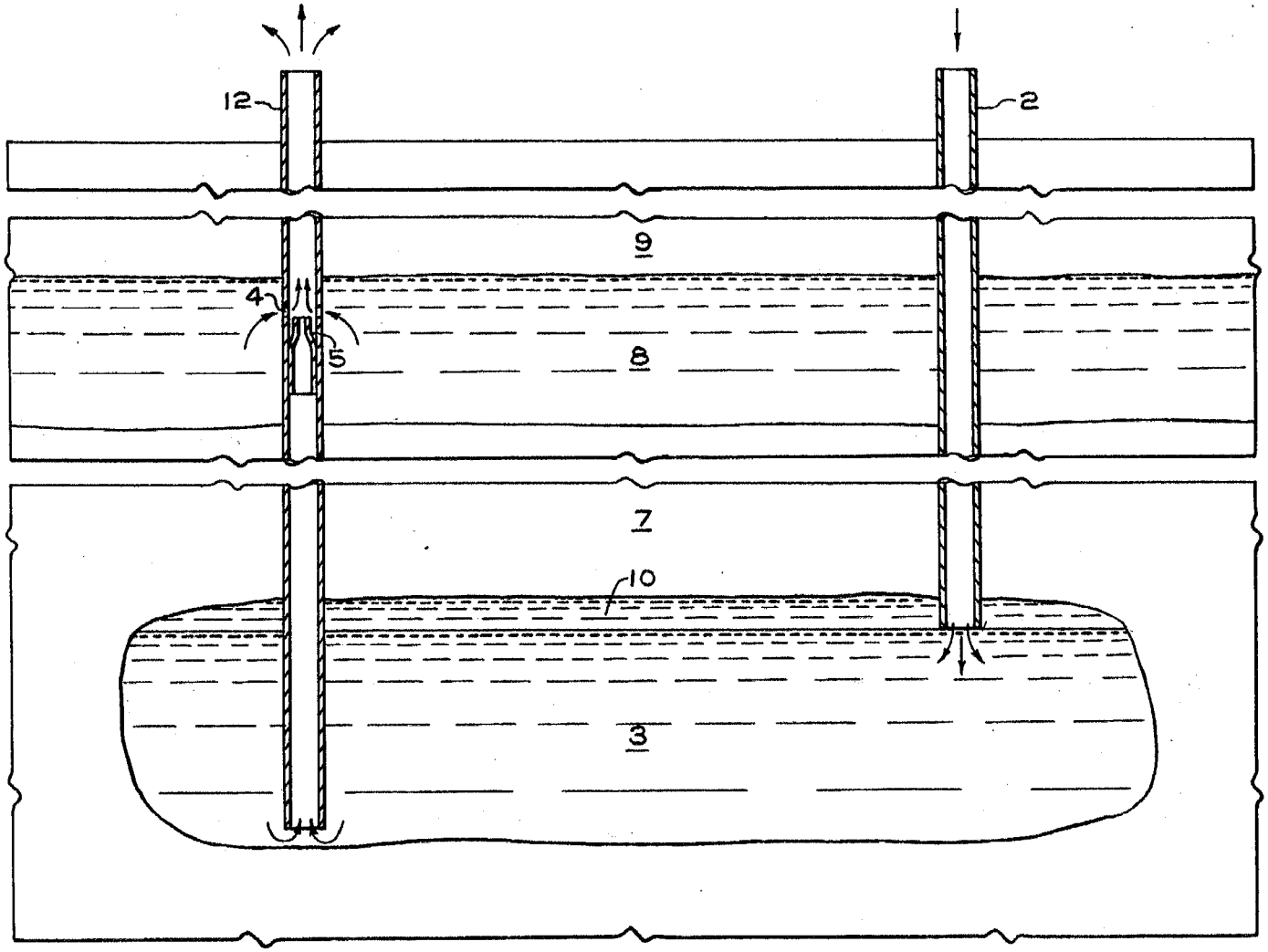
FIG. 2 diagrammatically illustrates a subterranean cavity in a mineral deposit being mined where there are two bore holes in communication therewith and having an overlying aquifer which is not in communication with a cavity.

Reference is now made to FIG. 2 which diagrammatically illustrates a cavity 3 in mineral deposit 7 being solution mined through two well bores, one of which serves as an injection well and the other serving as a withdrawal well. Again, soluble mineral deposit 7 is overburdened with formation 9 bearing aquifer 8. A solvent is injected through casing 2 into cavity 3 thereby extracting the soluble mineral 7 from the deposit. Immiscible liquid 10 is placed above the cavity solution to insulate the solvent from acting upon the roof. Saturated solution which settles to the bottom of the cavity 3 is withdrawn through casing 12 wherein restriction 5 is disposed. Similarly as described with reference to FIG. 1, the flow of the solution being withdrawn through conduit 12 induces the flow of water from aquifer 8 through hole 4 into casing 12. Hence, the water from the aquifer serves to dilute the saturated solution being withdrawn through conduit 12 such that soluble mineral 7 does not precipitate.

Figure 3:
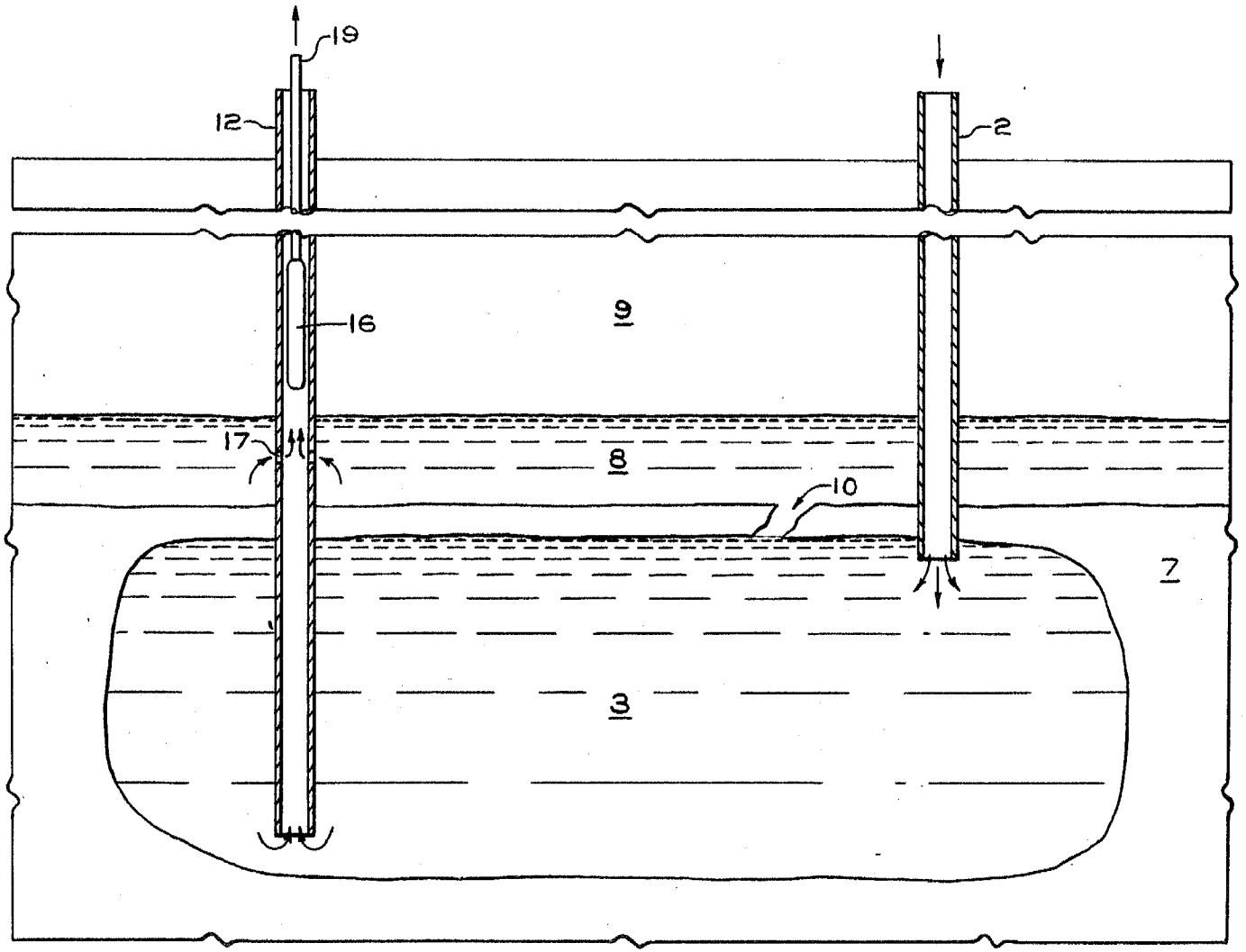
FIG. 3 diagrammatically illustrates a subterranean cavity in a mineral deposit being solution mined with two bore holes in communication therewith and having an overlying aquifer which is in communication with the cavity.

Reference is now made to FIG. 3 which diagrammatically illustrates a cavity being solution mined as depicted in FIG. 2 except in FIG. 3 aquifer 8 is in communication with cavity 3 via break 10. It can be seen that break 10 adversly affects the ability to pump solvent through casing 2 into cavity 3 and through withdrawal casing 12. Many times this ability to pump is even lost. It is only the cases where aquifer 8 is an artesian type where the pumping ability would not be completely lost. In cases where aquifer 8 is not an artesian type it is necessary to introduce into withdrawal casing 12 a submersible pump 16 below the head level equaling the pressure within aquifer 8. The use of this pump is taught by U.S. Pat. No. 3,652,129. This cavity is solution mined in accordance with the teaching of the patent by introducing the solvent into casing 2 and withdrawing solution through casing 12 at such a rate that a greater volume is introduced into the cavity than that which is withdrawn. In addition, according to the teaching of the present invention, holes are made in withdrawal casing 12 causing a communication between aquifer 8 and casing 12. Since solution is withdrawn from the casing by the submersible pump, the fluid level and thus pressure created by the fluid column is reduced resulting in a pressure differential being established across the hole 17 in casing 12 thereby causing flow of water from aquifier 8 into casing 12. The mixture of water from aquifer 8 with the solution being withdrawn dilutes the solution sufficiently so that soluble mineral 7 does not precipitate from the solution and plug withdrawal casing 12.

In the various embodiments depicted by FIGS. 1, 2 and 3, the hole 4 creating communication between the conduit and the aquifer is of a size such that no more than the amount which is necessary to avoid plugging is mixed with the withdrawn solution. This should be especially true when there is a contaminating effect of solutes that may be contained in the aquifer or when the relative difference between the density of the withdrawn enriched solution and the water of the aquifer should be considered. It can be readily seen that if aquifer 8 is an artesian type aquifer it may not be necessary to introduce submersible pump 16 or a similar type shaft pump into the withdrawal casing 12 and that the present invention can nontheless be practiced. It can also be seen that the flow of water from the aquifer through hole 4 into the conduit can be metered by a device such as a valve which is actuated from the earth surface to make adjustments to account for changes in the composition of the solution being withdrawn.

While the invention has been described with reference to certain specific embodiments, it is not intended to be limited thereby except insofar as appears in the accompanying claims.

What is claimed is:

1. In the method of solution mining a mineral from a subterranean deposit thereof by introducing into the deposit an aqueous solvent and withdrawing from the deposit through a conduit a solution richer in the mineral and wherein above the deposit is a water bearing formation traversed by the conduit, an improvement comprising establishing through the wall of the conduit communication between the water bearing formation and the conduit and creating a pressure differential across that wall of the conduit to effect dilution of the solution being withdrawn, thereby avoiding plugging of the conduit caused by precipitation of the mineral.

2. The method of claim 1, wherein the mineral is a mixture of potassium chloride and sodium chloride.

3. The method of claim 1, wherein the water bearing formation is in communication with a cavity from which the mineral enriched solution is withdrawn.

4. The method of claim 3, wherein a pump is introduced into the withdrawal conduit to pump the solution from the cavity and the communication between the water bearing formation and the conduit is a hole in the wall of the conduit.

5. The method of claim 1 or 4, wherein the water bearing formation is dilute with respect to the mineral.

6. The method of claim 4, wherein the size of the hole is predetermined to effect a metered amount of dilution of the withdrawn solution.

7. The method of claim 6, wherein the withdrawm solution is diluted to less than 97% saturation with respect to the mineral.

8. In the method of solution mining potassium chloride from a subterranean deposit containing potassium chloride and sodium chloride by introducing into the deposit an aqueous solvent and withdrawing from the deposit through a conduit a solution richer in one or both salts, wherein above a cavity from which the solution is withdrawn and in communication with the cavity is a water bearing formation dilute with respect to sodium chloride and potassium chloride, wherein the water bearing formation is traversed by the conduit, and wherein a pump is introduced into the conduit to pump the solution from the cavity, an improvement comprising establishing through the wall of the conduit communication between the water bearing formation and the conduit and creating a pressure differential across the wall of the conduit to effect dilution of the solution being withdrawn, thereby avoiding plugging of the conduit caused by precipitation of either salt.

9. The method of claim 8, wherein the withdrawn solution is diluted to less than 97% saturation with respect to either salt.

10. The method of claim 8, wherein communication between the water bearing formation and the conduit is metered to control the extent of dilution of the solution being withdrawn.

* * * * *